US010086522B2

(12) United States Patent
Contaldi

(10) Patent No.: US 10,086,522 B2
(45) Date of Patent: Oct. 2, 2018

(54) DOUBLE SIDED RAZOR AND METHOD OF USE

(71) Applicant: Walter Contaldi, Clifton, NJ (US)

(72) Inventor: Walter Contaldi, Clifton, NJ (US)

( * ) Notice: Subject to any disclaimer, the term of this patent is extended or adjusted under 35 U.S.C. 154(b) by 0 days.

(21) Appl. No.: 15/182,041

(22) Filed: Jun. 14, 2016

(65) Prior Publication Data

US 2016/0288350 A1 Oct. 6, 2016

Related U.S. Application Data

(63) Continuation-in-part of application No. 14/638,258, filed on Mar. 4, 2015.

(51) Int. Cl.

| | |
|---|---|
| ***B26B 21/52*** | (2006.01) |
| ***B26B 21/22*** | (2006.01) |
| ***B26B 21/40*** | (2006.01) |

(52) U.S. Cl.

CPC ..... *B26B 21/522* (2013.01); *B26B 21/222* (2013.01); *B26B 21/4081* (2013.01); *B26B 21/521* (2013.01); *B26B 21/527* (2013.01)

(58) Field of Classification Search

CPC ... B26B 21/222; B26B 21/527; B26B 19/102; B26B 19/3853; B26B 21/52; B26B 21/522; B26B 21/225; A45D 27/00

See application file for complete search history.

(56) References Cited

U.S. PATENT DOCUMENTS

| | | | | |
|---|---|---|---|---|
| 1,187,441 | A | 6/1916 | Miller | |
| 1,359,666 | A | 11/1920 | Brandt | |
| 2,150,260 | A | 3/1939 | Berry | |
| 4,461,078 | A | 7/1984 | Carreker | |
| 4,970,784 | A * | 11/1990 | Althaus | B26B 21/225 30/50 |
| 4,989,328 | A | 2/1991 | Sokoloff | |
| D391,021 | S | 2/1998 | van Oene | |
| 5,865,189 | A | 2/1999 | Andrews | |

(Continued)

FOREIGN PATENT DOCUMENTS

| | | |
|---|---|---|
| WO | 1997025189 | 7/1997 |
| WO | 2012120499 | 9/2012 |
| WO | WO-2016192743 A1 * | 12/2016 |

OTHER PUBLICATIONS

S4 Shark: Headblade, Inc., http://www.headblade.com/product/540016.html, accessed on Jan. 1, 2016.

*Primary Examiner* — Stephen Choi
(74) *Attorney, Agent, or Firm* — Gearhart Law LLC

(57) ABSTRACT

A double-ended manual razor is disclosed, with razor on either side of a handle. Each razor is offset from the handle at an opposite angle, with respect to a midpoint between the two razors, that midpoint also being a highest point of the handle, rising from each razor to a pinnacle in a curvilinear manner. One uses the razor by placing at least one finger on either side of the pinnacle and another under the pinnacle, such as in a concave finger region or circle, and pivots around the middle point, pushing either the one or the other razor downwards onto a surface to be shaved. Then, one switches direction and shaves in the other direction with the other razor, always or sometimes placing more pressure on the side of the device with the razor currently in use to shave or cut.

7 Claims, 13 Drawing Sheets

(56) References Cited

U.S. PATENT DOCUMENTS

| | | | | |
|---|---|---|---|---|
| 6,018,877 | A | 2/2000 | Greene | |
| D423,143 | S | 4/2000 | Cowell | |
| 6,052,905 | A | 4/2000 | Branchinelli et al. | |
| 6,082,007 | A | 7/2000 | Andrews | |
| 6,112,421 | A | 9/2000 | Greene | |
| 6,122,826 | A * | 9/2000 | Coffin | B26B 21/225 30/527 |
| 6,125,857 | A | 10/2000 | Siber | |
| 6,434,828 | B1 | 8/2002 | Andrews | |
| 6,493,950 | B1 | 12/2002 | Kludjian et al. | |
| 6,560,876 | B2 | 5/2003 | Carr | |
| 6,694,626 | B2 | 2/2004 | Kludjian et al. | |
| 6,823,594 | B2 | 11/2004 | Kludjian et al. | |
| 7,140,115 | B2 | 11/2006 | Greene | |
| D578,708 | S | 10/2008 | Ringart | |
| D585,157 | S | 1/2009 | Park | |
| 7,574,809 | B2 * | 8/2009 | Follo | B26B 21/225 30/50 |
| 8,387,259 | B2 | 3/2013 | Starr | |
| 8,782,911 | B1 | 7/2014 | Greene | |
| 2002/0050065 | A1 | 5/2002 | Kludjian et al. | |
| 2002/0194735 | A1 | 12/2002 | Cecil | |
| 2016/0193740 | A1 * | 7/2016 | Phillips | B26B 21/527 30/34.05 |

* cited by examiner

DOUBLE SIDED RAZOR AND METHOD OF USE

CLAIM OF PRIORITY

This application in a continuation in part of U.S. application Ser. No. 14/638,258 filed on Mar. 4, 2015, the contents of which are herein fully incorporated by reference in its entirety.

FIELD OF THE EMBODIMENTS

The field of the embodiments of the present invention relate generally to razors, and, more specifically, to double ended razors.

BACKGROUND OF THE EMBODIMENTS

Shaving is a chore. Men shave their heads and facial hair. Women shave their legs. In a common method of shaving, one has to take multiple strokes adjacent to each other, moving in the same directions. Razors blades are angled and only work in one direction. Attempts have been made to develop razors that work in both directions, but further development is still needed; nothing has removed the old fashioned razor from its throne. Such a razor, held at an acute angle to the elongated handle remains popular.

REVIEW OF RELATED TECHNOLOGY

U.S. Pat. No. 6,560,876 pertains to manual shaving razors. Particularly, the disclosure relates to a shaving razor with a handle with a shaving razor head at each of opposite ends of the razor handle.

U.S. Pat. No. 4,461,078 pertains to a razor assembly includes first and second handle portions, with first and second razor heads mounted at the ends of the handle portions. The first razor head is adapted to mount a conventional-width razor cartridge, while the second razor head is adapted to mount a styling razor cartridge, the styling razor head having a width about one-third that of the regular razor cartridge. The handle portions are pivotally mounted together so that the heads may be moved from a position wherein the handle portions are substantially in a straight line with the heads widely spaced, to a position wherein the handle portions make a small acute angle with the heads close to each other. The cartridges mounted by the heads are always parallel, and the blades extending from the cartridges are disposed on the same side of the handle U.S. Pat. No. 4,989,328 to Sokoloff pertains to a razor assembly includes dual razor heads mounted on a single handle. One razor head is adapted to hold a conventional size blade. The other razor head is adapted to hold a much smaller blade for convenient shaving around one's nostrils and for trimming of moustaches, beards and sideburns. The user can choose between either razor head simply by rotating the handle with his fingers.

Thus, various devices and methodologies are known in the art. However, their structure and means of operation are substantially different from the present disclosure. At least one embodiment of this invention is presented in the drawings below and will be described in more detail herein.

SUMMARY OF THE EMBODIMENTS

A double-bladed razor and its method of use are disclosed wherein each of two razors are positioned at either side of a handle, the handle having two sides with each side extending at an acute angle, with respect to a plane defined by the working ends of each razor, to a pinnacle positioned at a center point between each razor. The pinnacle defines a top of the device. When using the device, one can place least one finger directly below the pinnacle of the handle (and this finger either being otherwise un-surrounded by the device or surrounded by a portal of the device). Another finger can be placed above a first of the two sides of the device, with yet another finger above a second of the two sides of the device. Additional fingers can be placed in any of these locations. Then, one shaves in a first direction with a first razor while applying pressure with one of the fingers to this razor, and then switches direction of movement while, in some embodiments, keeping the same orientation of the device, and shaves with the second razor, applying pressure there-on with a different finger.

The pinnacle further defines a top of a loop enclosed by the handle, in some embodiments of the disclosed technology. A finger, such as a middle finger, can pass through the loop while shaving in the first direction and/or second direction. This pinnacle can be opposite a dimple (also referred to in the disclosure as "concave region") on a bottom side of the handle, pressing against this dimple while shaving in any direction, such as the first and second direction referenced above. A line of symmetry can pass through the pinnacle be halfway between each razor (a vertical line of symmetry).

Discussing further the double-sided razor itself, each of two razors are positioned at either side of a handle, in embodiments of the disclosed technology. The handle has two sides each side extended at an acute angle with respect to a plane defined by the working ends (sides used to cut) of each razor. The pinnacle of the handle is positioned at a center point between each razor, the pinnacle defining a top of the device. The handle can have an indentation with a curvilinear surface sized to fit a finger. This indentation can be part of a closed circle. Geometric shapes used in this disclosure can be within 5% (e.g. have a 5% tolerance level) of a true such shape. The indentation can be at a bottom side of the device, beneath the pinnacle and the pinnacle can form part of the indentation (on a top side thereof the material).

Another way to describe the double-ended razor of embodiments of the disclosed technology is that a first razor at a first end and a second razor at a second end define a lower plane. A handle extend between the first razor and the second razor, upwards from the lower plane until reaching a pinnacle. The pinnacle is at a halfway point between the first razor and the second razor and defines an upper plane. A concave region facing towards the lower plane is formed at the halfway point, which can form a line of symmetry, between the first razor and the second razor. The handle can rise curvilinearly from each of the razors towards the pinnacle. The concave region can be open on the other side of the material forming the concave shape (open to the lower plane) or it can be part of an enclosed circle.

Using the terminology above, the method of use of such a double ended razor is then described as follows. One presses a finger against the concave region, applying greater pressure on an upper side of the handle at the portion which is between the first razor and the pinnacle than between the pinnacle and the second razor when using the first razor. This is reversed when using the second razor. In other words, one then applies greater pressure on an upper side of the handle between the second razor and the pinnacle than between the pinnacle and said first razor when using the second razor.

When applying greater pressure between the first razor and the pinnacle, one can move the entire device in a direction more towards the second razor than the first razor (a first direction). When applying the greater pressure between the second razor and the pinnacle, one can move the razor in a direction more towards the first razor than the second razor (in an "opposite" direction, for example). One can then repeat this in a back and forth motion, alternating between placing greater pressure on one side of the device and then on another side of the device at the same frequency as one alternates between going back and going forth. The finger in the concave region can be used to pivot the razor each time one switches between the "back" and the "forth" direction of motion/each time one changes on which side one applies greater pressure to the handle.

In one embodiment of the present invention there is a razor handle comprising: an arcuate handle having a first end and a second end with each of the first end and the second end having a pair of coupling legs, the pair of coupling legs being configured to engage a recess of a first razor retainment body and a second razor retainment body; and two handle supports being coupled to the arcuate handle, with each of the two handle supports being configured to abut a portion of the first razor retainment body or the second razor retainment body.

In another embodiment of the present invention there is a razor comprising: an arcuate handle having a first end and a second end with each of the first end and the second end having a pair of coupling legs, wherein each leg of the pair of coupling legs bears a leg foot extending therefrom, the leg foot being configured to engage a recess of a first razor retainment body or a second razor retainment body; two handle supports coupled to the arcuate handle, with each of the two handle supports being configured to abut a retainment body support of the first razor retainment body or the second razor retainment body; the first razor retainment body configured to house at least one razor blade, wherein the first razor retainment body is coupled to the pair of coupling legs disposed at the first end of the arcuate handle; and the second razor retainment body configured to house at least one razor blade, wherein the second razor retainment body is coupled to the pair of coupling legs disposed at the second end of the arcuate handle.

In yet another embodiment of the present invention there is a razor comprising: an arcuate handle having a first end and a second end with each of the first end and the second end having a pair of coupling legs, wherein each leg of the pair of coupling legs bears a leg foot extending perpendicularly therefrom, the leg foot being configured to engage a recess of a first razor retainment body or a second razor retainment body; two handle supports coupled to the arcuate handle, with each of the two handle supports being configured to abut a retainment body support of the first razor retainment body or the second razor retainment body, wherein one of the two handle supports abuts the first razor retainment body and the other handle support abuts the second razor retainment body, and wherein the two handle supports are configured to limit rotation of the first and the second razor retainment body; the first razor retainment body configured to house a plurality of razor blades, wherein the first razor retainment body is coupled to the pair of coupling legs disposed at the first end of the arcuate handle; and the second razor retainment body configured to house a plurality of razor blades, wherein the second razor retainment body is coupled to the pair of coupling legs disposed at the second end of the arcuate handle; wherein the first razor retainment body and the second razor retainment body are oriented such that the plurality of razor blades housed by the first razor retainment body are configured to cut in a first direction and the plurality of razor blades housed by the second razor retainment body are configured to cut in a second direction.

"Substantially" and "substantially shown," for purposes of this specification, are defined as "at least 90%," or as otherwise indicated. Any device may "comprise" or "consist of the devices mentioned there-in, as limited by the claims.

It should be understood that the use of "and/or" is defined inclusively such that the term "a and/or b" should be read to include the sets: "a and b," "a or b," "a," "b."

In general, the present invention succeeds in conferring the following, and others not mentioned, benefits and objectives.

It is an object of the present invention to provide a razor that contains two razor cartridges.

It is an object of the present invention to provide a razor that may be maneuvered in multiple directions over a skin surface.

It is an object of the present invention to provide a razor that is ergonomically shaped for a user.

It is an object of the present invention to provide a razor that is lightweight and inexpensive.

It is an object of the present invention to provide a razor which enables the razor cartridges to be replaced.

It is an object of the present invention to provide a razor that allows selective pressure to be applied to each of the two razor cartridges.

It is an object of the present invention to provide a razor that is configured to be used on a variety of skin surfaces and textures.

DESCRIPTION OF THE PREFERRED EMBODIMENTS

Figure 1A:
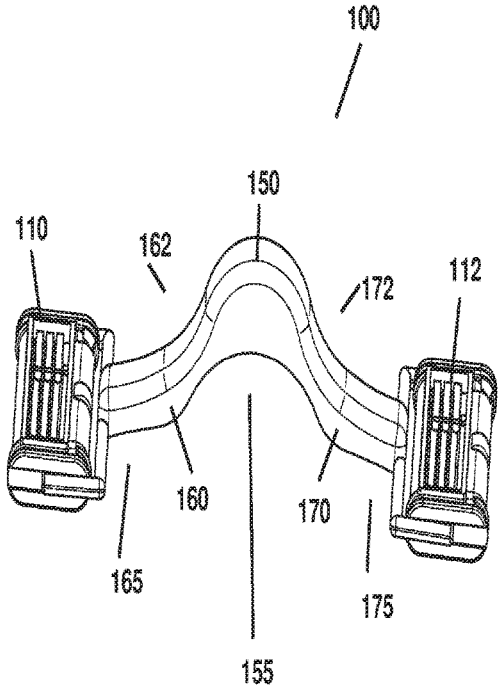
FIG. 1A shows a perspective view of an arched double-sided razor in an embodiment of the disclosed technology.

The preferred embodiments of the present invention will now be described with reference to the drawings. Identical elements in the various figures are identified with the same reference numerals.

Reference will now be made in detail to each embodiment of the present invention. Such embodiments are provided by way of explanation of the present invention, which is not intended to be limited thereto. In fact, those of ordinary skill in the art may appreciate upon reading the present specification and viewing the present drawings that various modifications and variations can be made thereto.

Embodiments of the disclosed technology include a double-ended razor/shaver with an arched handle extended there-between. The arch rises at an acute angle with respect to each razor, while each razor is attached at a mirrored angle from one another, with respect to a center point of the device between each razor. At the center point of the device is a pinnacle or raised area, defining an uppermost extremity of the device (where the reverse side of the razors form a lower side thereof). This pinnacle allows a person to place a finger underneath same, and use this finger as a "pivot" point to angle one razor, then the other further downwards. As such, one can shave in a first direction, and then reverse course and shave in an opposite second direction.

It should be understood that "razor" can include any cutting device, and is further used herein, and in the claims, to refer to either a "cutting device" or an "end of a handle where a cutting device attaches."

Embodiments of the disclosed technology will become clearer in view of the following discussion of the figures.

Figure 1B:
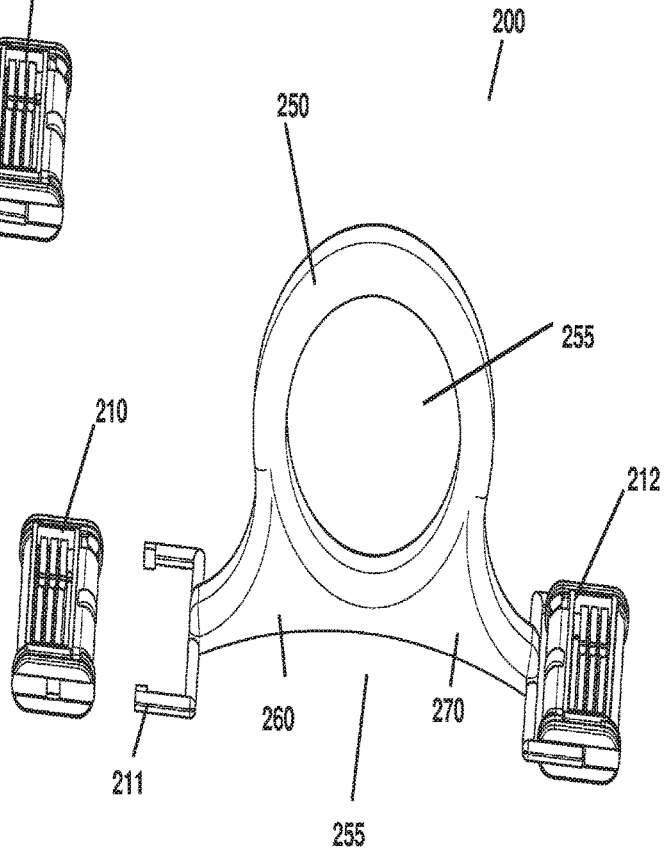
FIG. 1B shows a perspective view of a double-sided razor with finger portal in an embodiment of the disclosed technology.

FIG. 1A shows a perspective view of an arched double-sided razor in an embodiment of the disclosed technology. FIG. 1B shows a perspective view of a double-sided razor with finger portal in an embodiment of the disclosed technology. Elements of the arched embodiment are incremented by 100 for analogous or related parts of the finger portal embodiment.

Discussing first the arched embodiment 100, two razors 110 and 112 are disposed at opposite ends of the device. The business or working end of each razor points in a mirrored direction, which can include being connected to the handle at a mirrored angle. A "mirrored" angle, for purposes of this disclosure, is one in which has the same number of degrees, in absolute value, off from a vertical access passing perpendicular to the upper most extremity of the device. The "upper" extremity is defined by the arch 150 having a pinnacle in the center of two sides 160 and 170 which angle downwards towards each razor 110 and 112. This pinnacle is also the horizontal center of the device.

Under the arch is a cavity 155 which can be curvilinear, concave, and/or adapted for abutment by a finger such as the middle finger. Beneath the side 160 of the handle is a location 165 for placement of another finger, such as the index finger. Beneath the side 170 of the handle 170 is a location 175 for placement of yet another finger, such as the ring finger. The arch 150 is defined as beginning and ending where the derivative of the slope changes between a razor and pinnacle from a positive to a negative, or negative to a positive, closest to the pinnacle. This is further defined such that the arch 150 ends where the slope of the underside of the handle stops having a greater increase than previously, relative to a line formed from the razor to pinnacle. This is still further defined as an area beneath the handle which is concave; once the underside of the handle becomes convex, it is no longer part of arch 150.

Discussing in greater detail the areas exterior to the handle, above the handle between the arch 150 and razors 110 are two areas 162 and 172, on either side. A finger may be placed in one of these positions and a second finger, in the other position. Below the handle, between the arch 150 and each razor are two lower positions 165 and 175. A finger may be placed in one of these positions and a second finger, in the other position. A finger can also be placed within the concave cavity 155. In any of these cases, the finger rests or applies pressure on the handle extending between the two razors, either on the upper or lower side thereof. As such, greater pressure can be applied to one or the side of the device, against a person.

Referring now to the finger portal embodiment 200 and FIG. 1B, the arch 150 of the prior embodiment is replaced with a finger portal 255. This portal can be circular, oval, ovoid, square, rectangular, or the like. The finger portal 255 is within a closed loop 250 of any shape, in embodiments. This closed loop 250 reaches the pinnacle of the device, again halfway between the razor 210 and 212 and forms a vertical line of symmetry. The handle extends from this closed loop to one side of the handle 260 and the other side of the handle 270 with an area beneath, 255. In use, one places a finger though the finger portal 250 and at least two additional fingers either above and/or below the left portion 260 of the handle and right portion 270 of the handle.

Figure 2B:
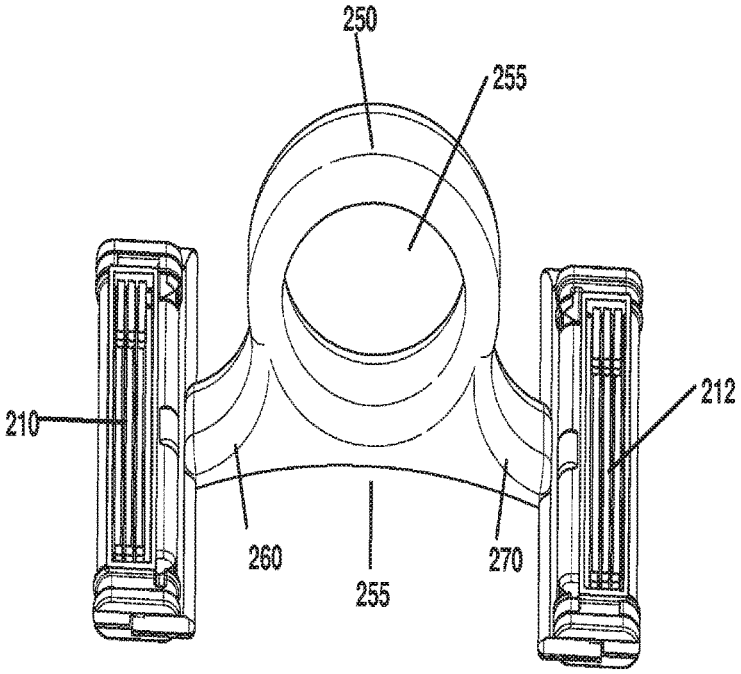
FIG. 2B shows a top and side perspective view of the embodiment shown in FIG. 1B.
Figure 2A:
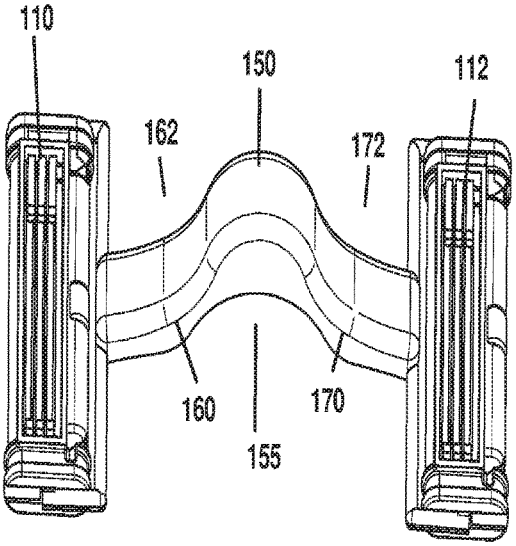
FIG. 2A shows a top and side perspective view of the embodiment shown in FIG. 1A.
Figure 3A:
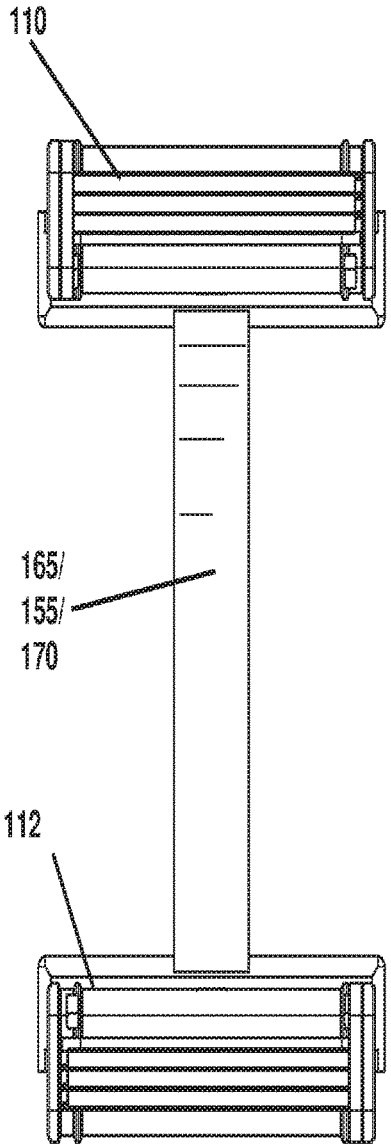
FIG. 3A shows a bottom view of the embodiment shown in FIG. 1A.
Figure 3B:
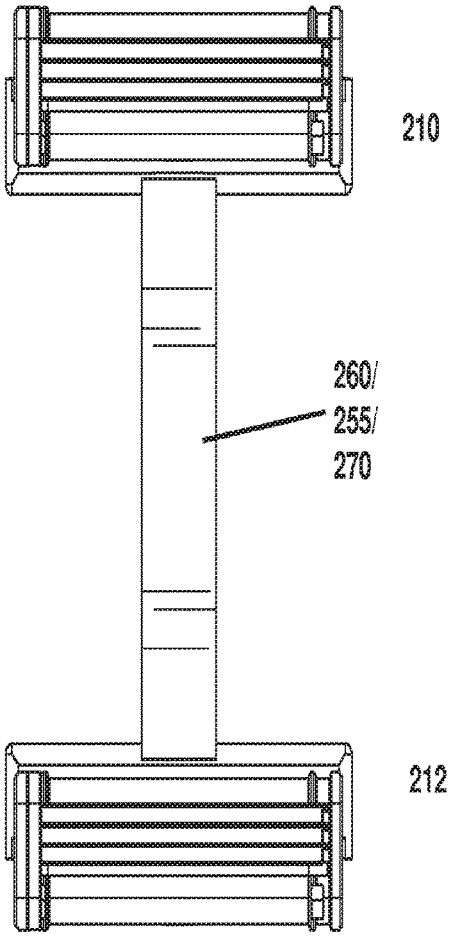
FIG. 3B shows a bottom view of the embodiment shown in FIG. 1B.

FIG. 2A shows a top and side perspective view of the device shown in FIG. 1A. FIG. 2B shows a top and side perspective view of the device shown in FIG. 1B. FIG. 3A shows a bottom view of the device shown in FIG. 1A. FIG. 3B shows a bottom view of the device shown in FIG. 1B.

Figure 4A:
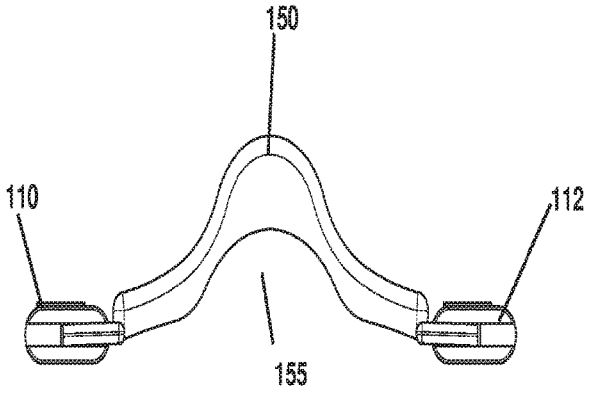
FIG. 4A shows a side elevation view of the embodiment shown in FIG. 1A.
Figure 4B:
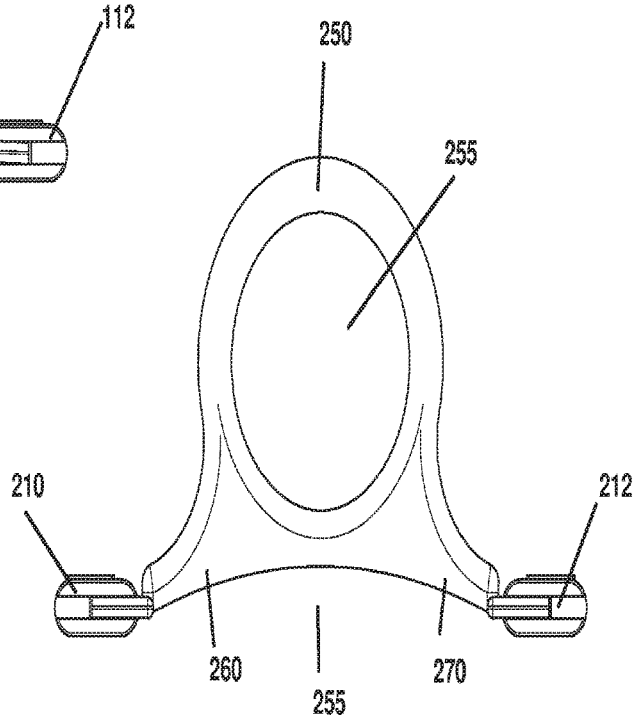
FIG. 4B shows a side elevation view of the embodiment shown in FIG. 1B.

FIG. 4A shows a side elevation view of the device shown in FIG. 1A. FIG. 4B shows a side elevation view of the device shown in FIG. 1B. In an embodiment of the disclosed technology, the dimensions of the elements shown in FIGS. 4A and 4B are precise and can be used to determine actual angles and/or dimensions of such embodiments represented therein.

Figure 5A:
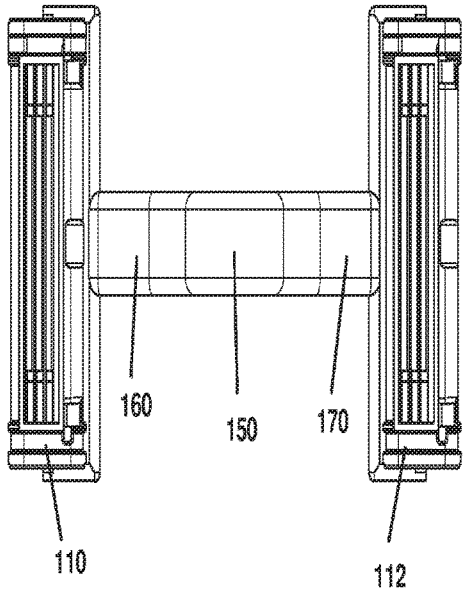
FIG. 5A shows a bottom view of the embodiment shown in FIG. 1A.
Figure 5B:
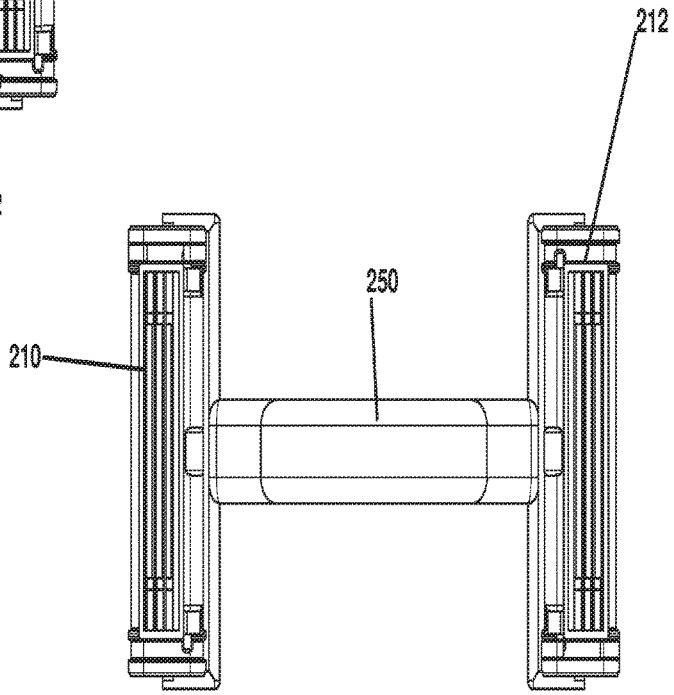
FIG. 5B shows a top view of the embodiment shown in FIG. 1A.

FIG. 5A and 5B shows a top view and a bottom view of the double-sided razor of FIG. 1A. In using the razor as shown, the razor 100 is placed against a leg 10. The leg 10 has shaving cream 11 there-on. A middle finger 3 is placed below the arch 150, between the leg 10 and the device 100. An index finger 2 is placed above the handle of the device 100 between a razor 112 and the arch 150. A ring finger 4 is placed above the handle of the device 100 between a razor 110 and arch of the device. The device 100 is situated between the leg 10 and the index 2/ring 4 fingers.

The razor 100 can then be moved in a downwards direction 20, towards the foot. The razor 112 is against the leg 10 and as such, there is greater pressure applied on the handle of the device 100 by the index finger 2 than the ring finger 4. When switching directions and going back upwards, away from the foot, the device remains in the same orientation (razor 112 above the razor 110, relative to the leg, other body part being shaved, and/or relative to the surface of the earth), but moves in a generally or substantially opposite direction with pressure applied being greater from ring finger 4 than index finger 2.

Figure 6:
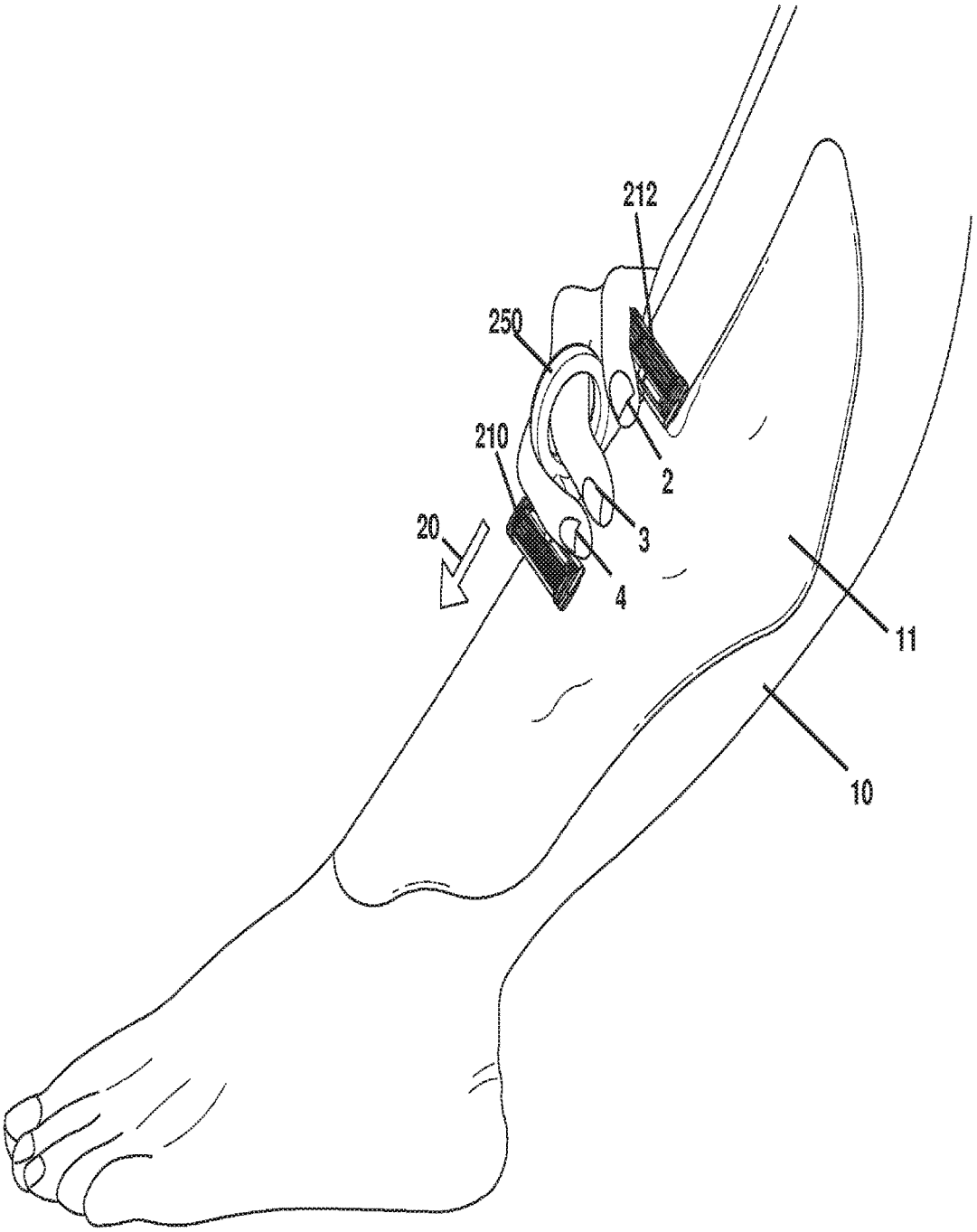
FIG. 6 illustrates a method of use of an embodiment of the present invention.
Figure 7:
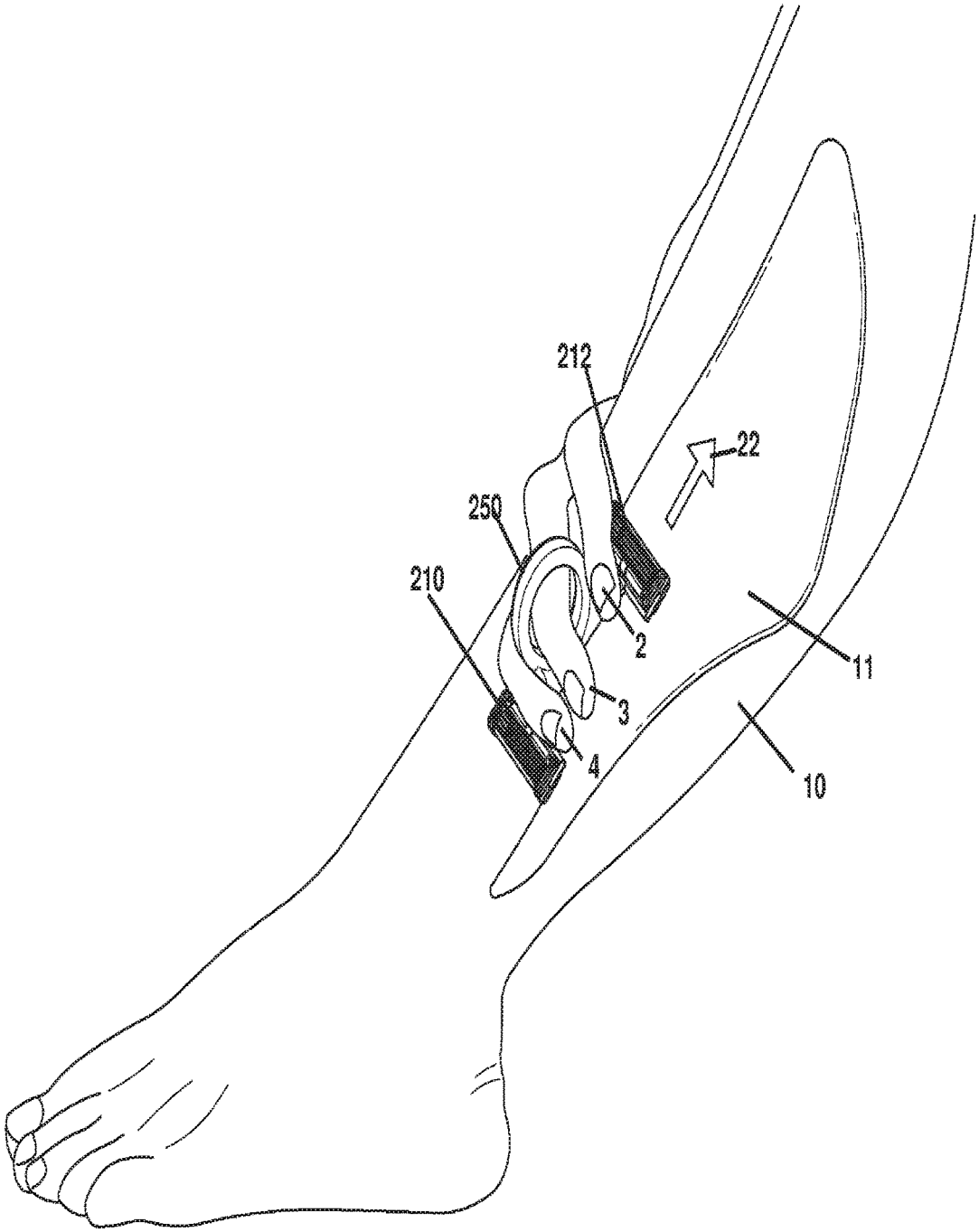
FIG. 7 illustrates the embodiment of FIG. 6, moving in the opposite direction.
Figure 8:
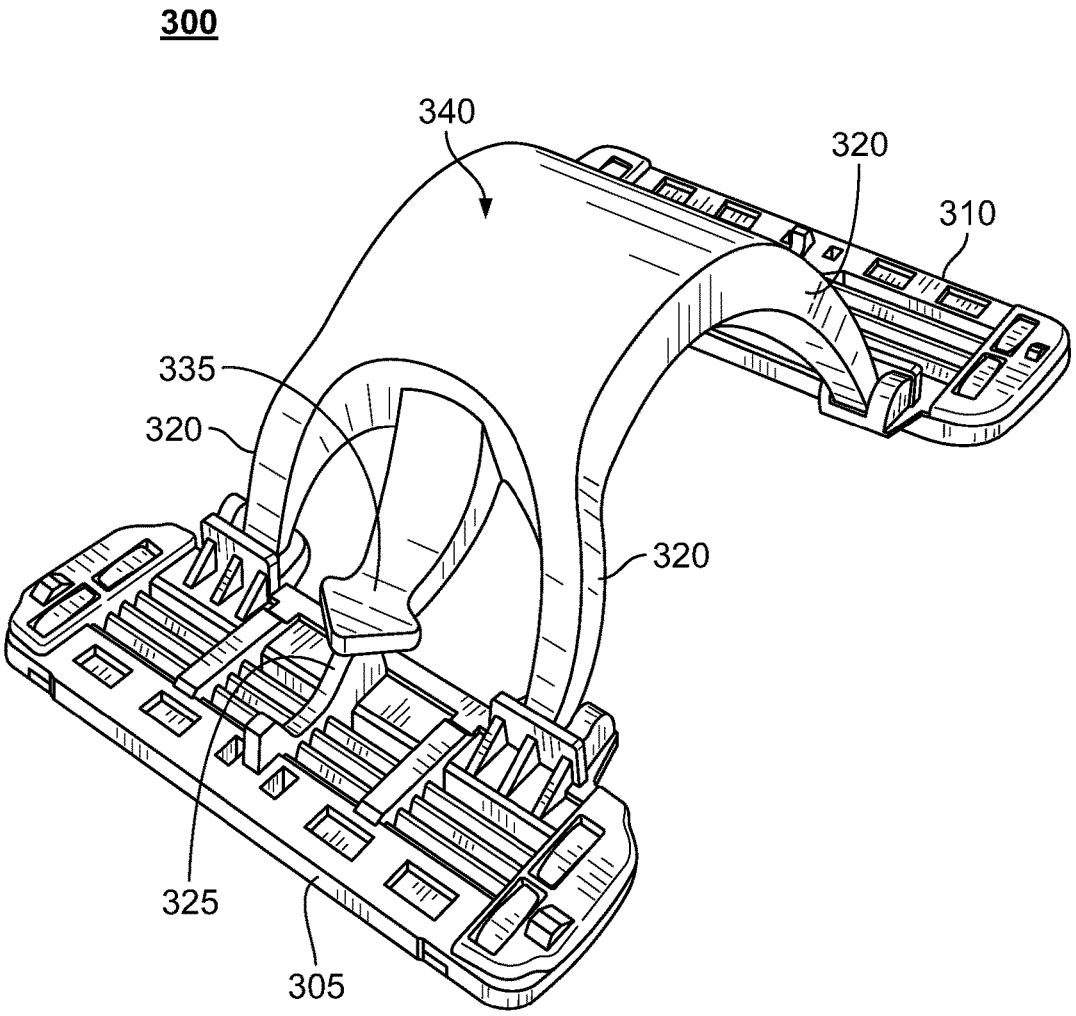
FIG. 8 is a perspective view of another embodiment of the present invention.
Figure 9:
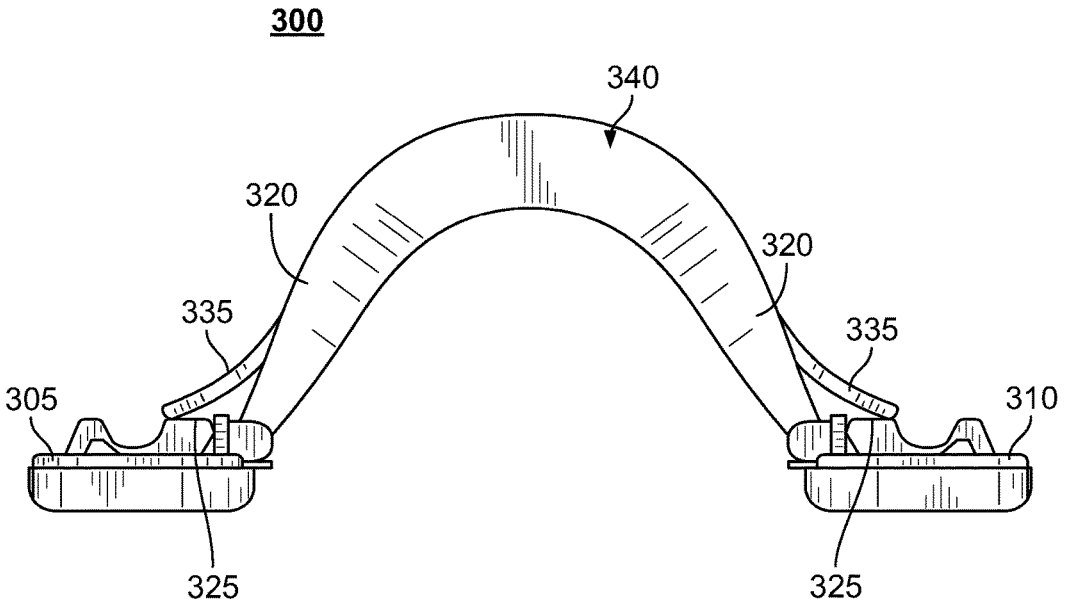
FIG. 9 is a side view of another embodiment of the present invention.
Figure 10:
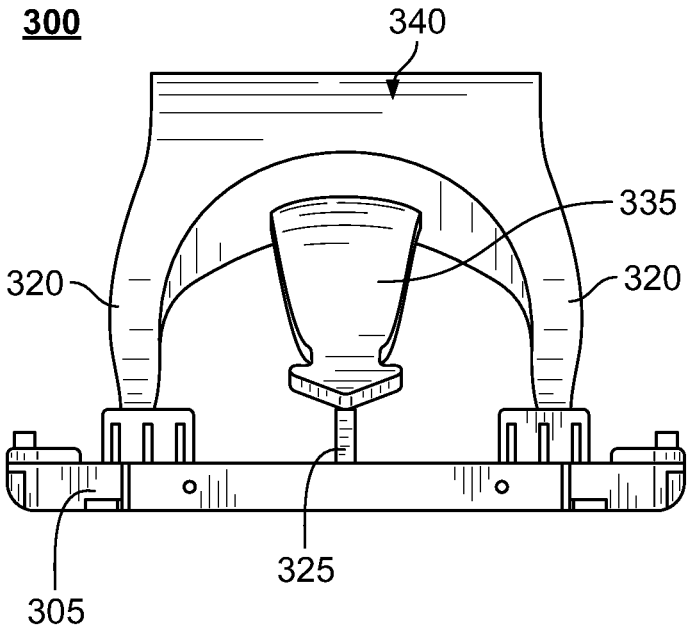
FIG. 10 is a front view of another embodiment of the present invention.

FIG. 6 shows a method of using the finger portal double-sided razor of FIG. 1B. FIG. 7 shows the embodiment of FIG. 7, moving in the opposite direction. Here, the finger portal device 200 is shown, first moving in a downward direction 20, and then in an upward direction 22. It can be seen that when finishing in a first direction, then the person reverses direction (defined as 180 degrees and/or within 5, 10, 20, 30, 46, 60, or 90 degrees thereof) and uses the other razor on the double-ended razor device, but keeps the device itself in the same orientation (having a change in direction less than and/or equal to 5, 10, 20, 30, 45, 60, or 90 degrees).

Referring now to FIGS. 8-13, there is another embodiment of the present invention. Here, a dual or double sided razor 300, generally has a first razor retainment body 305, a second razor retainment body, retainment body recess 315, coupling legs 320, retainment body supports 325, leg foots 330, handle supports 335, an arcuate handle 340, and a leg body 350.

Figure 14:
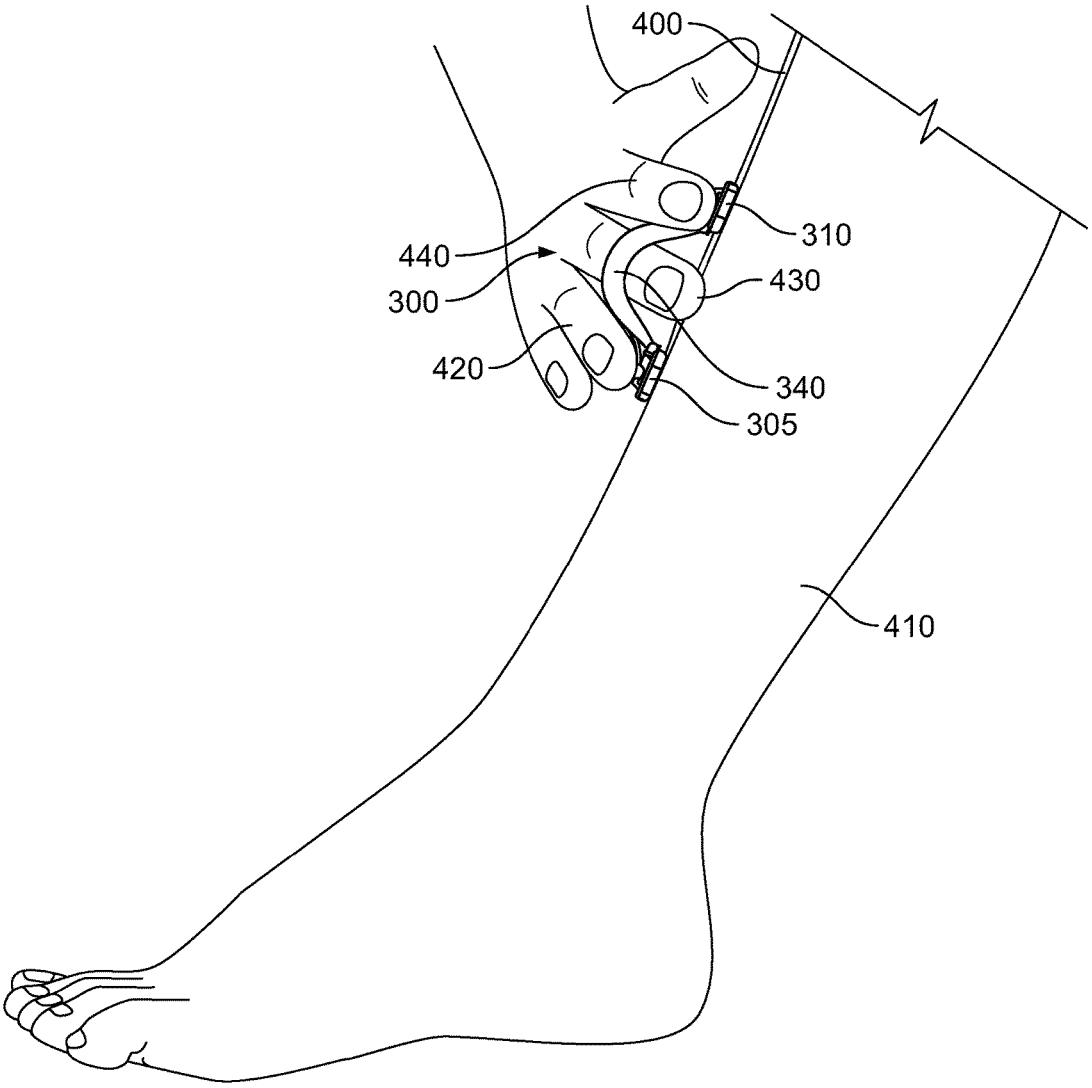
FIG. 14 illustrates a method of use of another embodiment of the present invention.

The arcuate handle 340 is generally arcuate in shape and configured to form an ergonomic hold for the user. As shown in FIG. 14, the user may place their index finger 440 and ring finger 420 on an upper surface of the arcuate handle 340. The index finger 440 and the ring finger 420 may be permitted to further rest on a portion of an upper surface of the first razor retainment body 305 and the second razor retainment body 310. The middle finger 430 may be positioned along a lower surface of the arcuate handle 340. However, various other finger configurations may be employed by the user when utilizing the present invention.

The arcuate handle 340 further defines coupling legs 320 and leg feet 330. The coupling legs 320 are disposed at each of a first end and a second end of the arcuate handle 340. The coupling legs 320 may be organized in pairs with each pair being coupled to one of the preferable two razor retainment bodies employed by the present invention.

Figure 13:
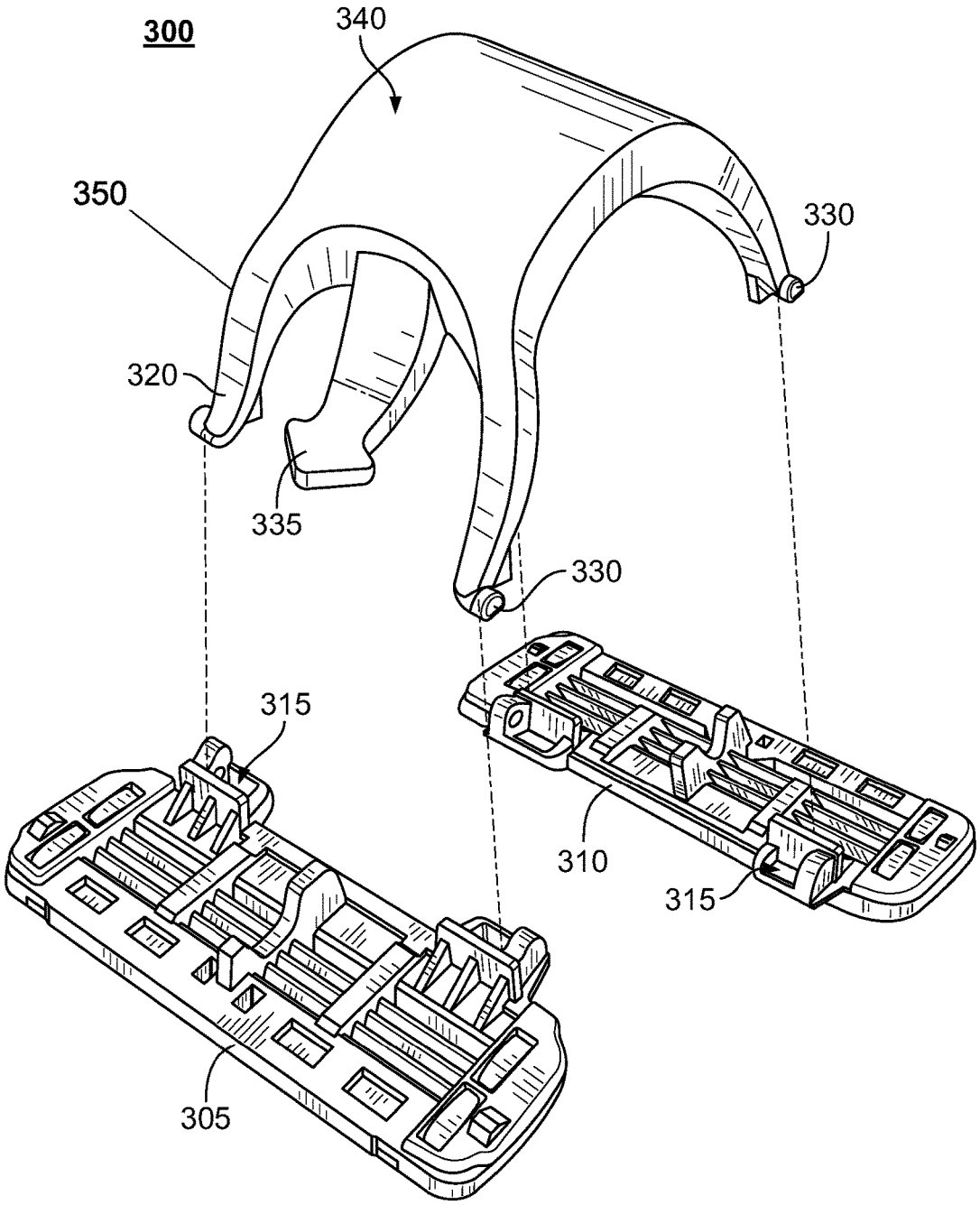
FIG. 13 is an exploded view of another embodiment of the present invention.

Each coupling leg 320 generally comprises a leg body 350 and leg foot 330. As shown in FIG. 13, the leg feet 330 are protrusions that extend generally perpendicularly from the leg body 350. The leg feet 330 are configured to engage recesses 315 on the razor retainment bodies. This engagement thereby couples the arcuate handle 340 to the razor retainment bodies. In order to complete the coupling process, a user may gently compress the coupling legs 320 inwards thereby allowing the protruding leg feet 330 to slip into the recesses 315. A reverse procedure may be utilized remove and/or replace the razor retainment bodies.

In addition, the arcuate handle 340 supports at least one and preferably two handle supports 335. The handle supports 335 may have the same general arcuate flow as the arcuate handle 340 thereby enabling a comfortable grip for the user. Further, the handle supports 335 are configured to abut or engage a retainment body support 325. When the arcuate handle 340 is coupled to the razor retainment bodies, the handle supports 335 are aligned with the retainment body supports 325. The handle supports 335 are shaped such that this relationship between structures prevents or limits rotation of the razor retainment bodies while the razor 300 is in use by the user. This enables an optimal shaving angle to be persistently and consistently maintained.

In some embodiments, it may be desirable that a shaving surface of the razor retainment bodies lie in the same plane (i.e. are flat with respect to one another). However, in other embodiments, it is preferable that the razor retainment bodies lie in different planes. Further, deviations (from parallel or flat) may be up to ±10°. In some embodiments, the particular angle formed by one of the razor retainment bodies may be the same or different as the other razor retainment body.

Figure 11:
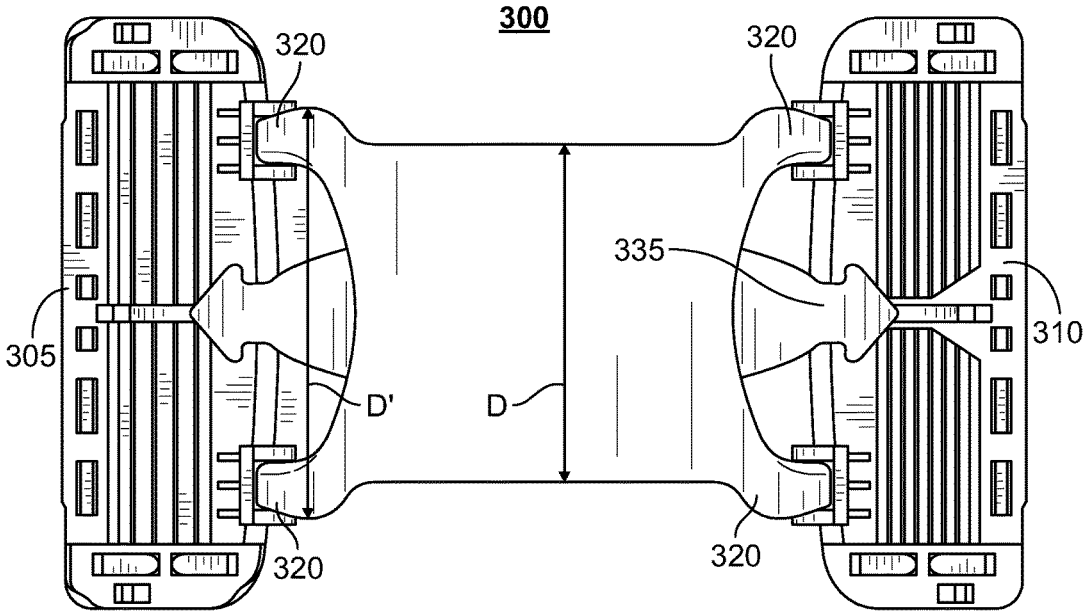
FIG. 11 is a top view of another embodiment of the present invention.
Figure 12:
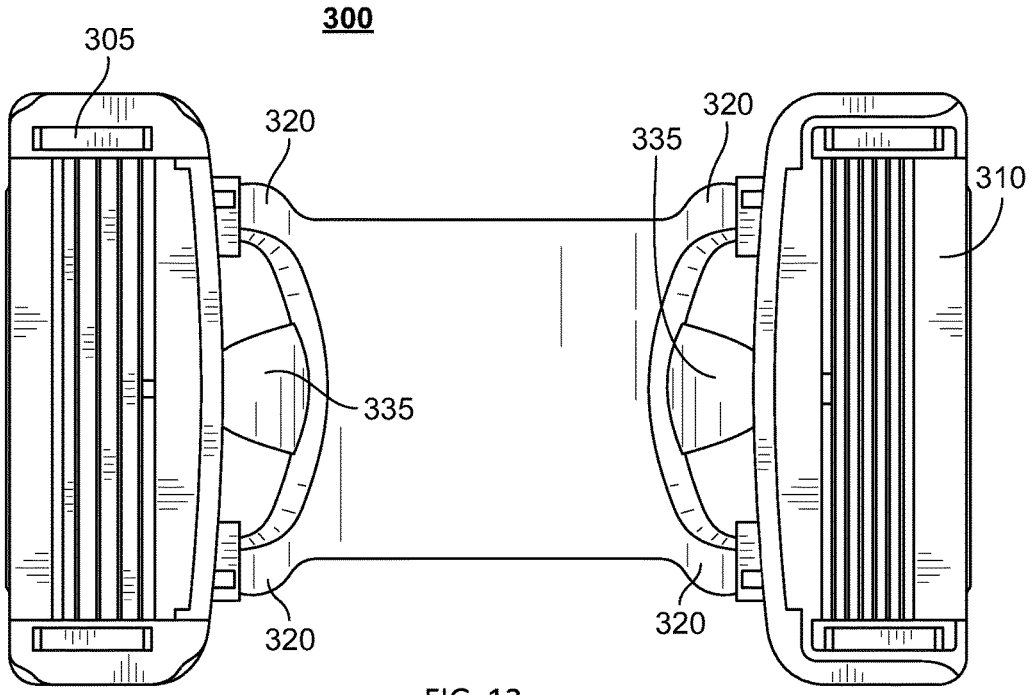
FIG. 12 is a bottom view of another embodiment of the present invention.

As shown in FIG. 11, the arcuate handle 340 has a first distance or width denoted "D" and the coupling legs 320 having a second distance or width "D'." The coupling legs 320 are configured to have a D' that is larger than the D of the handle thereby providing for enhanced stability and providing for the remaining of the physical structure of the arcuate handle 340 to be properly maintained.

Referring now to FIG. 14, there is an illustration demonstrating one method of using the embodiment described in FIGS. 8-13. Here, a user may put shaving cream or foam 400 on their leg 410 or other bodily surface to be treated with the razor 300. The user then positions their fingers along the upper surface and the lower surface of the arcuate handle 340. It is preferable that only one of the two razor retainment bodies (having razors blades contained therein) is in contact with the skin surface at any one given time.

In practice, the trailing razor retainment body should be in contact with the skin surface whereas the user's hand position is such that the leading razor retainment body is slightly elevated off the skin surface. This allows the trailing body to be the sole body cutting. In some arrangements, the razor retainment bodies, namely the razor blades, may be configured such that both are intended to be in contact with the skin surface thereby cutting in the same direction. However, this would prevent the desired "back and forth" contemplated by the present invention and its embodiments.

It should be understood that any configuration of the fingers can be used and any body part can be shaved with this method/device. For example, one can place two fingers on each side of the arch/finger portal, two fingers in the portal or under the arch, a finger above and below one side of the handle with another under the arch or in the finger portal, or the like. Any configuration allowing the user to press a razor against an area to be shaved can be used.

Still further, it should be understood that while a leg is shown in the drawings, this device has other applications, such as to shave a head. One can use the above-described methods to go back and forth over a head to shave, alternating which razor is used to shave with each change between the "back" and "forth" direction.

Although this invention has been described with a certain degree of particularity, it is to be understood that the present disclosure has been made only by way of illustration and that numerous changes in the details of construction and arrangement of parts may be resorted to without departing from the spirit and the scope of the invention.

What is claimed is:

1. A razor comprising:

an arcuate handle having an upper surface, a lower surface, a first side surface, a second side surface, a first end, and a second end with each of the first end and the second end having a pair of coupling legs, wherein each leg of the pair of coupling legs bears a leg foot extending therefrom, the leg foot being configured to engage a recess of each of a first razor retainment body or a second razor retainment body, wherein each of the upper surface and the lower surface form a single first arch extending from the first end to the second end, and wherein each of the first side surface and the second side surface define a single second arch extending from the first end to the second end;

two handle supports coupled to the arcuate handle, with each of the two handle supports being configured to abut a retainment body support of one of the first razor retainment body and the second razor retainment body, wherein the two handle supports are shaped to have the same arcuate flow as that of the arcuate handle, and wherein the two handle supports are configured to prevent rotation of each of the first razor retainment body and the second razor retainment body;

the first razor retainment body configured to house at least one razor blade, wherein the first razor retainment body is coupled to the pair of coupling legs disposed at the first end of the arcuate handle; and the second razor retainment body configured to house at least one razor blade, wherein the second razor retainment body is coupled to the pair of coupling legs disposed at the second end of the arcuate handle.

2. The razor of claim 1 wherein an upper surface of the arcuate handle is configured to receive an index finger and a ring finger of a user.

3. The razor of claim 1 wherein a lower surface of the arcuate handle is configured to receive a middle finger of a user.

4. The razor of claim 1 wherein the first and the second razor retainment body contain a series of parallel razor blades.

5. The razor of claim 1 wherein the pair of coupling legs are positioned to have a spacing that is greater than a width of the arcuate handle.

6. A razor comprising:

a handle having an upper surface, a lower surface, a first end, and a second end, with the upper surface and the lower surface forming a single arch, the single arch having a single maximum at a midpoint between the first end and the second end and the single maximum being at a point above a top surface of a first razor retainment body and a top surface of a second razor retainment body with each of the first end and the second end having a pair of coupling legs affixed directly thereto, wherein the handle has an open lower surface extending from the first end to the second end, wherein each leg of the pair of coupling legs bears a leg foot extending perpendicularly therefrom, the leg foot being configured to engage a recess of each of the first razor retainment body or the second razor retainment body, and wherein the pair of coupling legs are positioned such that a spacing between each leg forming the pair of coupling legs is greater than a width of a central portion of the handle;

two handle supports extending outwardly from the handle, with each of the two handle supports being configured to abut a retainment body support of one of the first razor retainment body and the second razor retainment body, wherein one of the two handle supports abuts the first razor retainment body and the other handle support abuts the second razor retainment body, wherein the two handle supports are shaped to have the same arcuate flow as that of the arch of the handle thereby aligning each of the two handle supports with each pair of the coupling legs, and wherein the two handle supports are configured to prevent rotation of the first and the second razor retainment body;

the first razor retainment body configured to house a plurality of razor blades, wherein the first razor retainment body is coupled to the pair of coupling legs disposed at the first end of the handle; and the second razor retainment body configured to house a plurality of razor blades, wherein the second razor retainment body is coupled to the pair of coupling legs disposed at the second end of the handle;

wherein the first razor retainment body and the second razor retainment body are oriented such that the plurality of razor blades housed by the first razor retainment body are configured to cut in a first direction and the plurality of razor blades housed by the second razor retainment body are configured to cut in a second direction;

wherein a first side of an upper surface of the handle is configured to receive an index finger and a second side of the upper surface of the handle is configured to receive a ring finger of a user; and wherein the open lower surface of the handle is configured to receive a middle finger of a user.

7. The razor of claim 6 wherein each of the first razor retainment body and the second razor retainment body are positioned +10° or −10° from normal.

* * * * *